United States Patent [19]

Light

[11] Patent Number: 4,903,039

[45] Date of Patent: Feb. 20, 1990

[54] TRANSPARENT IMAGE-RECORDING ELEMENTS

[75] Inventor: William A. Light, Victor, N.Y.

[73] Assignee: Eastman Kodak Company, Rochester, N.Y.

[21] Appl. No.: 393,443

[22] Filed: Aug. 14, 1989

[51] Int. Cl.[4] ..... B41M 5/00

[52] U.S. Cl. ..... 346/1.1; 427/256; 427/261; 428/195; 428/206; 428/327; 428/336; 428/480; 428/483; 428/500; 428/914; 346/135.1

[58] Field of Search ..... 346/1.1, 135.1; 427/256, 261; 428/195, 206, 327, 336, 480, 483, 500, 914

[56] References Cited

U.S. PATENT DOCUMENTS

| | | | |
|---|---|---|---|
| 3,563,942 | 2/1971 | Heiberger | 524/602 |
| 3,734,874 | 5/1973 | Kibler et al. | 524/603 |
| 3,779,993 | 12/1973 | Kibler et al. | 524/22 |
| 4,425,405 | 1/1984 | Murakami et al. | 428/537 |
| 4,503,111 | 3/1985 | Jaeger et al. | 428/195 |
| 4,578,285 | 3/1986 | Viola | 428/195 |
| 4,686,118 | 8/1987 | Arai et al. | 428/195 |
| 4,741,969 | 5/1988 | Hayama et al. | 428/514 |

OTHER PUBLICATIONS

Derwent Abstract of Japanese Public Disclosure No. J61032788-A, published Feb. 15, 1986.

*Primary Examiner*—Pamela R. Schwartz
*Attorney, Agent, or Firm*—Bernard D. Wiese

[57] ABSTRACT

Transparent image-recording elements that contain ink-receptive layers that can be imaged by the application of liquid ink dots. The ink-receptive layers contain a combination of a vinyl pyrrolidone polymer with a polyester, a poly(cyclohexane-dimethylene-co-oxydiethylene isophthalate-co-sodio-sulfobenzenedicarboxylate), dispersed in the vinyl pyrrolidone to control ink dot size. A printing method which employs the transparent image-recording elements is described.

9 Claims, No Drawings

TRANSPARENT IMAGE-RECORDING ELEMENTS

FIELD OF THE INVENTION

This invention relates to transparent image-recording elements that contain ink-receptive layers that can be imaged by the application of liquid ink dots. More particularly, this invention relates to transparent image-recording elements in which the ink-receptive layer comprises a vinyl pyrrolidone polymer and a polyester. This invention also relates to a printing process employing such elements.

BACKGROUND

Transparent image-recording elements are primarily intended for viewing by transmitted light, for example, observing a projected image from an overhead projector. In a typical application, the viewable image is obtained by applying liquid ink dots to an ink-receptive layer using equipment such as ink jet printers involving either monochrome or multicolor recording.

It is known that the ink-receptive layers in transparent image-recording elements must meet stringent requirements including, an ability to be readily wetted so there is no "puddling" i.e., coalescence of adjacent ink dots that leads to non-uniform densities; an earlier placed dot should be held in place in the layer without "bleeding" into overlapping and latter placed dots; the layer should exhibit the ability to absorb high concentrations of ink so that the applied liquid ink does not run i.e., there is no "ink run off"; a short ink-drying time and a minimum of haze. To meet these requirements the ink-receptive layers of the prior art have been prepared from a wide variety of materials. One class of materials that has been described for use in ink-receptive layers of transparent image-recording elements is the class of vinyl pyrrolidone polymers. Typical patents are as follows:

U.S. Pat. No. 4,741,969 issued May 3, 1988, describes a transparent image-recording element having an ink-receptive layer formed from a mixture of a photopolymerizable, double-bonded anionic synthetic resin and another polymer such as a homo- or copolymer of N-vinyl pyrrolidone. The mixture is cured to provide the ink-receptive layer.

U.S. Pat. No. 4,503,111, issued Mar. 5, 1985, describes a transparent image-recording element for use in ink jet recording and having an ink-receptive layer comprising a mixture of polyvinyl pyrrolidone and a compatible matrix-forming hydrophilic polymer such as gelatin or polyvinyl alcohol.

Unfortunately, transparent image-recording elements that have been described in the prior art and employ vinyl pyrrolidone polymers in ink-receptive layers have generally failed to meet the stringent requirements needed to provide a high quality image and this has significantly restricted their use.

In addition to the requirements already discussed, an important feature of a projection viewable image is the size and nature of the ink dots that form it. In general, a larger dot size (consistent with the image resolution required for a given system) provides higher image density and a more saturated color image and improves projection quality. A known method of increasing dot size involves applying liquid ink dots to a transparent image-receiving sheet, for example, HP PaintJet Film TM (commercially available from Hewlett Packard Company, Palo Alto, California) using an ink jet printer. The sheet is dried for a short time, for example, 5 minutes, and inserted into a transparent plastic sleeve which protects the sheet and controls development of the dots. The sleeve compresses the dots and their size is increased to provide greater image density and color saturation upon projection of the image. Although this method is effective, it would be desirable to achieve appropriate dot size without the inconvenience of handling a separate sleeve.

It is an objective of this invention to provide a transparent image-recording element having an ink-receptive layer that contains a vinyl pyrrolidone polymer and will meet the needs of printing processes such as ink jet printing wherein liquid ink dots are applied to the layer to form a high quality projection viewable image. In addition, it is an objective of this invention to provide a simple and effective means for controlling the dot size on the ink-receptive layer of a transparent image-recording element.

SUMMARY OF THE INVENTION

In accordance with this invention a polyester, as described hereinafter, is used in combination with a vinyl pyrrolidone polymer in an ink-receptive layer of a transparent ink-recording element to control dot size and provide a high quality projection viewable image. This result is achieved in a simple and expedient manner by varying the concentration of the polyester in the layer, as illustrated hereinafter. Furthermore, as shown in the following Example 1, substituting either the vinyl pyrrolidone polymer or the polyester in the combination with a similar polymer that has been suggested for use in ink-receptive layers in the past seriously impairs image quality. Accordingly, it is believed that the beneficial effect achieved with the combination of vinyl pyrrolidone polymer and the polyester described herein can be obtained with only a small number of materials. In this regard, the present inventor has found only two other types of polyesters that will provide such effect, as described in copending U.S. Pat. Application Ser. No. 393441, entitled "Transparent Image-Recording Elements Comprising Vinyl Pyrrolidone Polymers" and copending U.S. Pat. Application Ser. No. 393,445, entitled "Transparent Recording Elements Comprising Vinyl Pyrrolidone Polymers and Polyesters", each filed of even date herewith.

Thus, this invention provides a transparent image-recording element adapted for use in a printing process where liquid ink dots are applied to an ink-receptive layer that contains a vinyl pyrrolidone polymer and particles of a polyester, poly(cyclohexylenedimethylene-co-oxydiethylene isophthalate-co-sodiosulfobenzenedicarboxylate), dispersed in the vinyl pyrrolidone to thereby control ink dot size.

This invention also provides a printing process in which liquid ink dots are applied to the ink-receptive layer of the aforementioned element.

DESCRIPTION OF THE PREFERRED EMBODIMENTS

The ink-receptive layer in the novel transparent image-recording elements of this invention contains a vinyl pyrrolidone polymer. Such polymers and their use in ink-receptive layers of the type disclosed herein are well known to those skilled in the art and include homopolymers of vinyl pyrrolidone, as well as copolymers thereof with other polymerizable monomers. Useful materials include polyvinyl pyrrolidone, and copolymers of vinyl pyrrolidione with copolymerizable monomers such as vinyl acetate, methyl acrylate, methyl methacrylate, ethyl acrylate, ethyl methacrylate, butyl acrylate, butyl methacrylate, methyl acrylamide, methyl methacrylamide, and vinyl chloride. Typically, the polymers have viscosity average molecular weights ($\overline{M}_v$) in the range of about 10,000 to 1,000,000, often about 300,000 to 850,000. Such polymers are typically soluble in aqueous media and can be conveniently coated from such media. A wide variety of the vinyl pyrrolidone polymers are commercially available and/or are disclosed in a number of U.S. Pats. including U.S. Pat. Nos. 4,741,969; 4,503,111; 4,555,437 and 4,578,285. The concentration of the vinyl pyrrolidone polymer in the ink-receptive layer is subject to wide variation. It is used in sufficient concentration to absorb or mordant the printing ink in the layer. A useful concentration is generally in the range of about 10 to 50, often 20 to 40 percent based on the dry weight of the layer.

The polyesters that form the dispersed particles in the elements of this invention are poly(cyclohexylenedimethylene-co-oxydiethylene isophthalate-co-sodiosulfobenzenedicarboxylates). The polyester particles are dispersed within the vinyl pyrrolidone polymer to provide a ink-receptive layer comprising a continuous phase of vinyl pyrrolidone polymer and a discontinuous phase of dispersed polyester particles. Examples of specific polyesters useful in the practice of this invention include poly(1,4-cyclohexanedimethylene-co-2,2'-oxydiethylene (46,54) isophthalate-co-5-sodiosulfo-1,3-benzenedicarboxylate (82/18)) and poly(1,4-cyclohexanedimethylene-co-2,2'-oxydiethylene (70/30) isophthalate-co-5-sodiosulfo-1,3-benzenedicarboxylate (86/14)). The numbers immediately following the monomers refer to mole ratios of the respective diol and acid components. The particles of polyester generally have a diameter up to about 1 micrometer, often about 0.001 to 0.1 and typically 0.01 to 0.08 micrometer. The size of the polyester particles in a layer is, of course, compatible with the transparency requirements for a given situation. The ratio, by weight, of polyester to vinyl pyrrolidone polymer in the ink-receptive layer is typically at least about 1:1 and is generally in the range of about 1:1 to 6:1, although any amount that is effective to achieve the desired control in dot size can be used. Useful polyesters are known in the prior art and procedures for their preparation are described, for example, in U.S. Pat. Nos. 3,018,272, issued Jan. 23, 1962; 3,563,942, issued Feb. 16, 1971; 3,779,993, issued Dec. 18, 1973; and 3,734,874, issued May 22, 1973, the disclosures of which are hereby incorporated herein by reference. The polyesters are linear condensation products formed from two diols, i.e., cyclohexanedimethanol and diethylene glycol and two diacids, i.e., isophthalic acid and sulfoisophthalic acid and/or their ester-forming equivalents. Such polyesters are dispersible in water or aqueous media and can be readily coated from such media. In general, such polyesters have an inherent viscosity of at least 0.1 often about 0.1 to 0.7 measured in a 60/40 parts, by weight, solution of phenol/tetrachloroethane at 25° C. and at a concentration of about 0.5 g of polymer in 1 deciliter of solvent.

The transparent image-recording elements of this invention can contain optional additional layers and components known to be useful in such elements in general, such as for example, overcoat layers, surfactants, plasticizers, and matting agents. For example, the ink-receptive layer can be overcoated with an ink-permeable layer that permits ink to pass freely therethrough and protect the surface of the ink-receptive layer and prevent such layer from becoming sticky under highly humid conditions. Layers of this type are described in U.S. Pat. No. 4,686,118 and materials useful for the formation of such layers include homopolymers of copolymers formed from vinyl acetate, acrylic acid esters, ethylene, vinyl chloride or other vinyl monomers, polyvinyl alcohols, polyurethane, cellulose derivatives, polyesters and polyamides. Examples of suitable matting agents that can contribute to the non-blocking characteristics and control friction of the transparent recording elements include materials such as starch, titanium dioxide, zinc oxide, calcium carbonate, barium sulfate, silica and polymeric beads such as polymethyl methacrylate beads copoly(methyl methacrylate-divinylbenzene) beads, polystyrene beads and copoly(vinyl toluene-t-butylstyrene-methacrylic acid) beads. The composition and particle size of the matting agent is selected so as not to impair the transparent nature of the image-receiving element.

The image-recording elements of this invention comprise a support for the ink-receptive layer. A wide variety of such supports are known and commonly employed in the art. They include, for example, those supports used in the manufacture of photographic films including cellulose esters such as cellulose triacetate, cellulose acetate propionate or cellulose acetate butyrate, polyesters such as poly(ethylene terephthalate), polyamides, polycarbonates, polyimides, polyolefins, poly(vinyl acetals), polyethers and polysulfonamides. Polyester film supports, and especially poly(ethylene terephthalate) are preferred because of their excellent dimensional stability characteristics. When such a polyester is used as the support material, a subbing layer is advantageously employed to improve the bonding of the ink-receptive layer to the support. Useful subbing compositions for this purpose are well known in the photographic art and include, for example, polymers of vinylidene chloride such as vinylidene chloride/acrylonitrile/acrylic acid terpolymers or vinylidene chloride/methyl acrylate/itaconic acid terpolymers.

The ink-receptive layers are coated from aqueous dispersions comprising the vinyl pyrrolidone polymer in solution in the aqueous medium and dispersed particles of polyester. Such dispersions are coated as a thin layer on the support and dried. The dispersion can be coated on the support by any of a number of suitable procedures including immersion or dip coating, roll coating, reverse roll coating, air knife coating, doctor blade coating, bead coating, and curtain coating. The thickness of the ink-receptive layer can be varied widely. The thickness of an ink-receptive layer imaged by liquid ink dots in an ink jet recording method is typically in the range of about 0.004 to 0.025 mm, and often in the range of about 0.008 to 0.016 mm, dry thickness.

The transparent image-recording elements of this invention are employed in printing processes where liquid ink dots are applied to the ink-receptive layer of the element. A typical process is an ink jet printing process which involves a method of forming type characters on a paper by ejecting ink droplets from a print head from one or more nozzles. Several schemes are utilized to control the deposition of the ink droplets on the image-recording element to form the desired ink dot pattern. For example, one method comprises deflecting electrically charged ink droplets by electrostatic means. Another method comprises the ejection of single droplets under the control of a piezoelectric device. Such methods are well known in the prior art and are described in a number of patents including, for example, U.S. Pat. Nos. 4,636,805 and 4,578,285.

The inks used to image the transparent image-recording elements of this invention are well known for this purpose. The ink compositions used in such printing processes as ink jet printing are typically liquid compositions comprising a solvent or carrier liquid, dyes or pigments, humectants, organic solvents, detergents, thickeners, preservatives, and the like. The solvent or carrier liquid can be predominantly water, although ink in which organic materials such as polyhydric alcohols, are the predominant carrier or solvent liquid are also used. The dyes used in such compositions are typically water-soluble direct or acid type dyes. Such liquid ink compositions have been extensively described in the prior art including for example, U.S. Pat. Nos. 4,381,946, issued May 3, 1983; 4,386,961, issued June 7, 1983; 4,239,543, issued Dec. 16, 1980; 4,176,361, issued Nov. 27, 1979; 4,620,876, issued Nov. 4, 1986; and 4,781,758, issued Nov. 1, 1988.

The following examples are presented to further illustrate this invention.

EXAMPLE 1

Preparation of Transparent Image-Recording Element

A poly(ethylene terephthalate) film 101.6 micrometers thick, coated with a subbing layer comprising a terpolymer of a acrylonitrile, vinylidene chloride and acrylic acid was used as a support for the transparent image-recording elements.

A series of aqueous coating compositions comprising 24.6g water, poly(vinyl pyrrolidone) 630,000 viscosity average molecular weight, $\overline{M}_v$, (available from GAF Corp. as PVPK-90) poly(1,4-cyclohexanedimethylene-co-2,2'-oxydiethylene (46/54) isophthalate-co-5-sodiosulfo-1,3-benzenedicarboxylate (82/1118)) inherent viscosity 0.33 (available from Tennessee Eastman Company as AQ55S) and 0.06g of nonylphenoxypolyglycidol (available from 01in Mathieson Co. as Surfactant 10G) were used to form ink-receptive layers on the aforesaid support. Varying amounts of the polyvinyl pyrrolidone and the polyester were used in the compositions, as indicated in the following Table I.

The compositions were prepared by stirring the ingredients at 88° C. for two hours and allowed to cool to approximately 20° C. In each case there was obtained a dispersion of polyester particles approximately 0.02 to 0.05 micrometer in diameter in the aqueous polyvinyl pyrrolidone solution. These dispersions were coated in layers 0.203 mm in thickness and dried to a thickness of 0.015 mm.

PRINTING

Images were formed on the transparent image-recording elements prepared as described above using a drop on demand ink jet printer to apply ink dots. The printer used was a Diconix 150 TM ink jet printer and the ink was a black ink, Diconix Plain Paper InkJet Cartridge Black Ink TM. The ink was applied at a loading of 1.3 microliters/cm$^2$. The images were examined visually and photomicrographs were made. Ink dots sizes were measured from the photomicrographs and are recorded in the following Table I.

TABLE I

| Run No. | Coating Dispersion: Vinyl Pyrrolidone Polymer (g) | Polyester (g) | Dot Size [mil (mm)] |
|---|---|---|---|
| 1 | 0.5 | 1.5 | 7.9 (0.2) |
| 2 | 0.8 | 1.2 | 6.3 (0.16) |

A comparison of the values reported in the above Table demonstrates that changing the amounts of vinyl pyrrolidone polymer and polyester in the ink-receptive layers of the transparent ink-receiving elements of this invention provides a simple and effective means for controlling dot size.

To demonstrate the excellent image quality obtainable with the transparent image-recording elements of this invention, the procedure of this Example 1 was repeated using a Diconix 150 TM ink jet printer modified to include an additional print head to deliver an ink load of 2.6 microliters/cm$^2$. This simulates multiple imaging techniques as occurs in multicolor recording. Even at this high ink loading the image quality was good; there being no significant "ink run-off", "puddling" or "dot bleed", as described hereinbefore. Furthermore, the higher ink loading had the advantage of increasing dot density.

In contrast, a repeat of Runs 1 and 2 with substituting the vinyl pyrrolidone polymer by hydroxyethyl cellulose or gelatin of the type suggested in the prior art for use in ink receptive layers of receiving elements for ink jet printing resulted in severe deterioration in image quality as indicated, for example, by haziness in the layers, "dot bleed" and "ink run off". Likewise, the substitution of the polyester in Runs 1 and 2 by a similar polymer containing sulfo groups, i.e., ammonium polystyrene sulfonate provided ink receptive layers that exhibited severe "puddling".

EXAMPLE 2

The procedure of Example 1 was repeated except that the polyester used was poy(1,4-cyclohexanedimethylene-co-2,2'-oxydiethylene (70/30) isophthalate-co-5-sodiosulfo-1,3-benzenedicarboxylate (86/14)), inherent viscosity 0.36. The ink dot sizes were measured from photomicrographs as described in Example 1. Like Example 1, the size of the ink dots decreased from 7.9 mils (0.2 mm) to 6.3 mils (0.16 mm) when the amount of polyester was increased from 0.5 grams to 0.8 grams in the coating dispersion.

EXAMPLE 3

The procedure of Example 1 was repeated with coating dispersions having the amounts of polyvinyl pyrrolidone and polyester set forth in the following Table II. Dot size was observed and measured as described in the Example 1 and is reported in the following Table II.

TABLE II

| Run No | Coating Dispersion: Vinyl Pyrrolidone Polymer (g) | Polyester (g) | Dot Size [mil (mm)] |
|---|---|---|---|
| 1 | 0.15 | 0.85 | 10.5 (0.25) |
| 2 | 0.2 | 0.8 | 8.4 (0.21) |
| 3 | 0.25 | 0.75 | 7.9 (0.2) |
| 4 | 0.5 | 0.5 | 5.2 (0.13) |

The invention has been described in detail with particular reference to preferred embodiments thereof, but it will be understood that variations and modifications can be effected within the spirit and scope of the invention.

I claim:

1. In a transparent image-recording element comprising a support and an ink-receptive layer, said element adapted for use in a printing process where liquid ink dots are applied to the ink-receptive layer that contains a vinyl pyrrolidone polymer, the improvement wherein the layer comprises particles of a polyester, poly(cyclohexylenedimethylene-co-oxydiethylene isophthalate-co-sodiosulfobenzenedicarboxylate), dispersed in the vinyl pyrrolidone polymer to thereby control ink dot size.

2. The element of claim 1 wherein the ratio, by weight, of the polyester to the vinyl pyrrolidone polymer is in the range of about 1:1 to 6:1.

3. The element of claim 1 wherein the ink-receptive layer is about 0.004 to 0.025 mm thick.

4. The element of claim 1 wherein the particles have a diameter up to about 1 micrometer.

5. The element of claim 4 wherein the polyester is poly(1,4-cyclohexanedimethylene-co-2,2'-oxydiethylene (46/54) isophthalate-co-5-sodiosulfo-1,3-benzenedicarboxylate (82/18)).

6. The element of claim 4 wherein the polyester is poly(1,4-cyclohexanedimethylene-co-2,2'-oxydiethylene (70/30) isophthalate-co-5-sodiosulfo-1,3-benzenedicarboxylate (86/14)).

7. The element of claim 1 wherein the ink-receptive layer is on a polyester film support.

8. The element of claim 7 wherein the polyester is poly(ethylene terephthalate).

9. A printing process in which liquid ink dots are applied to an ink-receptive layer of a transparent image-recording element, the improvement wherein the element is an element of claim 1.

* * * * *